United States Patent [19]

Gullett

[11] 4,310,117

[45] Jan. 12, 1982

[54] ENVELOPE

[75] Inventor: John R. Gullett, Quakertown, Pa.

[73] Assignee: Moore Business Forms, Inc., Grand Island, N.Y.

[21] Appl. No.: 81,442

[22] Filed: Oct. 3, 1979

[51] Int. Cl.[3] ..... B65D 27/06

[52] U.S. Cl. ..... 229/73; 229/70; 282/25

[58] Field of Search ..... 229/69, 80, 70, 73; 282/25, 11.5 R, 11.5 A; 206/632

[56] References Cited

U.S. PATENT DOCUMENTS

| | | | |
|---|---|---|---|
| 2,777,631 | 1/1957 | Zalkind | 229/73 |
| 2,983,525 | 5/1961 | Mercur | 282/25 |
| 3,312,385 | 4/1967 | Amort | 229/73 |
| 3,552,641 | 1/1971 | Bell et al. | 229/70 |
| 3,764,061 | 10/1973 | Holbert | 229/70 |
| 3,854,654 | 12/1974 | Van Malderghem | 229/69 |
| 3,866,822 | 2/1975 | Faltin et al. | 229/69 |
| 3,900,159 | 8/1975 | Gendron | 229/69 |

FOREIGN PATENT DOCUMENTS

| | | | |
|---|---|---|---|
| 659556 | 3/1963 | Canada | 282/25 |
| 2359029 | 2/1978 | France | 229/70 |
| 449402 | 4/1968 | Switzerland | 229/80 |
| 1020859 | 8/1964 | United Kingdom | 229/80 |

*Primary Examiner*—Stephen P. Garbe

*Attorney, Agent, or Firm*—Allegretti, Newitt, Witcoff & McAndrews

[57] ABSTRACT

An improved envelope for photographic film, prints and the like includes an adhesive strip and a protective strip for protecting the envelope from damage from the adhesive strip. The envelope can be used in the transfer of unprocessed film to a processor, reused in the return of the film and prints after processing, and further re-used in film storage. The envelope further includes detachable receipts, one for the recordal of pre-chosen information, and a transfer sheet for recordal of the pre-chosen information simultaneously on the receipt and the front of the envelope. The transfer sheet is detachable to eliminate damage to the processed film and any prints from inadvertant transfer of the transfer medium.

5 Claims, 4 Drawing Figures

ENVELOPE

BACKGROUND OF THE INVENTION

This invention relates to envelopes, and more particularly, to envelopes for the transfer of documents and things such as processed and unprocessed photographic film.

Photographers, both amateur and professional, utilize the services of photographic film processing laboratories for the development of exposed photographic film. Because a laboratory is typically distant from a photographer and prefers transactions involving bulk processing, the routine transaction between a photographer and a laboratory involves a local vendor of the services of the laboratory, such as a department store or photographic specialty shop. The photographer travels to the local vendor with exposed film, and contracts with the vendor for the transfer of the film to the laboratory, the processing and the return transfer. The photographer returns to the vendor at a time when the processing has been scheduled to be completed and the film returned, and, if the film has been returned, receives the processed film and pays the vendor for processing and handling. The vendor then pays the laboratory for the processing.

Because laboratories transact business with many vendors for the development of the film of multitudes of photographers, many laboratories require that exposed film be transferred in envelopes carrying information that includes an order number and identifies the vendor, the customer and the specific developing services desired. As an economy measure, the processed film is returned in the identical envelope. The photographer is given a receipt or claim check including the order number for rapid identification of the envelope upon its return to the vendor.

Because the envelope must be sealed before transfer to the laboratory, opened at the laboratory and resealed before return to the vendor, envelopes for the transfer of film have in the past included a flap having a small patch of tacky adhesive that provides a temporary seal of the envelope. The envelopes have also included receipts formed along the flaps that are separable from the flaps by the perforation of perforation lines therebetween.

While envelopes of this type have been of significant value, they have a variety of disadvantages, particularly with respect to the tacky adhesive utilized to seal the envelope. First, the tacky adhesive has an extremely limited useful life, preventing the effective resealing of the envelope more than a few times. Because photographers frequently store their film and prints in these envelopes, this is a significant shortcoming. Second, the patch of tacky adhesive may become ineffective immediately after first use by the vendor, if excessive pressure is applied to the tacky adhesive, because fibers may tear from the envelope and collect on the tacky adhesive. Third, the patch of tacky adhesive may not provide an effective seal at all, if insufficient pressure is applied, or if exposure of the patch prior to use of the envelope has resulted in the collection of debris on the patch. Fourth, the patch seals only a portion of the opening of the envelope, thereby permitting the film and other objects and things to escape the envelope.

In addition to the disadvantages of the tacky adhesive, the envelopes do not provide for a vendor receipt, or any receipt having the information as provided to the laboratory. If, as often happens, a photographer approaches the vendor for the return of processed film without having the photographer receipt or claim check with him, the vendor has no method for identifying the envelope to be given the photographer without randomly examining all the envelopes in his possession.

SUMMARY OF THE INVENTION

It is thus an object of the present invention to provide an improved envelope for the transfer of documents and things such as processed and unprocessed photographic film.

Another object of the present invention is to provide an improved envelope for the transfer of photographic film and the like which is more readily resealable than envelopes provided with tacky adhesive.

Another object of the present invention is to provide an improved envelope for the transfer of photographic film and the like which prevents the tearing of fibers from the envelope.

Another object of the present invention is to provide an improved envelope for the transfer of photographic film and the like which prevents the loss of film and the like from the envelope.

Another object of the present invention is to provide an improved envelope for the transfer of photographic film and the like which provides an effective and safe seal over a range of manual pressure which includes pressures which would not result in an adequate and safe seal by a patch of tacky adhesive.

Another object of the present invention is to provide an improved envelope for the transfer of photographic film and the like which prevents the damage of the adhesive from the collection of debris upon the adhesive.

A further object of the present invention is to provide an improved envelope for the transfer of photographic film and the like which provides a vendor receipt for use by the vendor of the services of a photographic film processing laboratory.

A further object of the present invention is to provide an improved envelope for the transfer of photographic film and the like which includes a receipt having information chosen from, or duplicating, the information recorded on the envelope, without the need of a second recordal of this information.

A still further object of the present invention is to provide an improved envelope for the transfer of photographic film and the like which includes a receipt having information transferred from the information recorded on the envelope, and which does not risk damage to the photographic film by inadvertant transfer of the transfer medium thereto.

In accord with these objects, the present invention is, in a principal aspect, an improved envelope for the transfer of documents and things such as processed and unprocessed photographic film. The envelope principally comprises a first sheet, a second sheet, means for attaching the second sheet to the first sheet, a contact adhesive strip, and a protective strip. The first sheet has a first end, a second end opposite the first end, a first side edge extending between the first end and the second end, a second side edge opposite the first side edge and extending between the first end and the second end, an inner side and an outer side opposite the inner side. The first sheet further has a fold line remote from the first end, remote from the second end and extending between the first side edge and the second side edge. The fold line defines two portions of the first sheet. One of the two portions of the first sheet is a flap portion defined between the fold line and the first end and the other of the two portions is an envelope portion defined between the fold line and the second end.

The second sheet has a first end, a second end opposite the first end, a first side edge extending between the first end and the second end, a second side edge opposite the first side edge and extending between the first end and the second end, an inner side, and an outer side opposite the inner side. The second sheet further has a length between the first end and the second end substantially equal to the distance between the fold line and the second end of the first sheet. The width of the second sheet between the first side edge and the second side edge is substantially equal to the distance between the first side edge and the second side edge of the first sheet.

The means for attaching the second sheet to the first sheet attaches the second sheet to the first sheet so as to form an envelope space, with the inner side of the first sheet facing the inner side of the second sheet, the second end of the second sheet generally aligned with and attached to the second end of the second sheet, the first side edge of the second sheet generally aligned with and attached to the portion of the first side edge of the first sheet along the envelope portion thereof, and the second side edge of the second sheet generally aligned with and attached to the portion of the second side edge of the first sheet along the envelope portion thereof. The contact adhesive strip has a width substantially equal to the distance between the first side edge of the first sheet and the second side edge of the first sheet, and has a pre-selected length. The protective strip protects the envelope from damage from the contact adhesive strip, and has a width and a length substantially equal to the pre-selected width and pre-selected length, respectively, of the adhesive strip.

One of the adhesive strip and the protective strip is joined to the inner side of the second sheet adjacent the first end thereof and extending from the first side edge of the first sheet to the second side edge of the first sheet. The other of the adhesive strip and the protective strip is joined to the outer side of the second sheet at a distance from the first end thereof substantially equal to the distance of the one strip from the fold line of the first sheet. The other strip also extends from the first side edge of the second sheet to the second side edge of the second sheet. Thus, the one strip overlies the other strip when the first sheet is folded along the fold line and the flap portion of the first sheet is brought into contact with the outer side of the second sheet. The adhesive strip thereby adheres to the protective strip and the envelope is readily reusable by separation of the contact adhesive strip from the protective strip. As so constructed, the envelope can be used in the transfer of unprocessed photographic film to a processor for processing, reused for the return transfer of the film after processing, and further reused by the photographer for film storage, with small risk of loss of the unprocessed or processed photographic film and with virtually no risk of damage to the adhesive strip or envelope because of tearing of the envelope.

In another principal aspect, the present invention is an envelope substantially as described with the first sheet further including a perforation line and a first information zone, with a third sheet, with means for attaching the third sheet to the first sheet, and with information transfer means. The perforation line is between the line end of the first sheet and the fold line of the first sheet, and extends from the first side edge of the first sheet to the second side edge of the first sheet. The perforation line defines two sections of the flap portion of the first sheet. One of the two sections of the flap portion is a first stub section defined between the first end of the first sheet and the perforation line. The other of the two sections of the flap portion is a flap section defined between the perforation line and the fold line. The first information zone is defined on the outer side of the first sheet within the envelope portion thereof. The first information zone is for the recordal of pre-selected information.

The third sheet has a first end, a second end opposite the first end, a first side edge extending between the first end and the second end, a second side edge opposite the first side edge and extending between the first end and the second end, a first side and a second side opposite the first side. The third sheet further has a second information zone defined on its first side for the recordal of pre-chosen information, with the pre-chosen information being chosen from among the pre-selected information. The length of the third sheet between the first edge and the second information zone is substantially equal to the distance between the first information zone and the first edge of the first sheet. The width of the third sheet along at least a portion of its length is less than the pre-selected width of the first sheet so that the third sheet fits within the envelope space defined by the first sheet and the second sheet.

The means for attaching the third sheet to the first sheet attaches the third sheet to the first stub portion. The third sheet is thereby attached to the first stub portion with the first edges of the first sheet and the second sheet generally aligned, with the first side of the third sheet adjacent the inner side of the first sheet, and with the third sheet within the envelope space of the first sheet and the second sheet.

The information transfer means is for transferring, upon recordal, the pre-chosen information from the first information zone to the second information zone. The transfer means is positioned between the first information zone and the second information zone. The transfer means is attached to the third sheet by means for making the attachment.

As so constructed, the envelope provides that the preselected information may be recorded on the first sheet, the first perforation line may be perforated and the third sheet may be removed from the envelope space, with the result being, without further recordal of information and without need of a separate receipt, an envelope for the safe transfer of documents and things having the pre-selected information thereon and a separate sheet for retention as a receipt with only the pre-chosen information thereon.

As should now be understood, the present invention provides many advantages and satisfies the foregoing objects. These and other objects and advantages of the present invention will become apparent from the detailed description of the preferred embodiment, which follows.

BRIEF DESCRIPTION OF THE DRAWING

The preferred embodiment of the present invention is hereafter described in relation to the accompanying drawing, wherein.

In the following Detailed Description Of The Preferred Embodiment, terms such as "top", "bottom" and the like are used for ease of illustration. It is to be understood that these terms are illustrative and not restrictive, since the position of the envelope does not affect its structure.

DETAILED DESCRIPTION OF A PREFERRED EMBODIMENT

Figure 1:
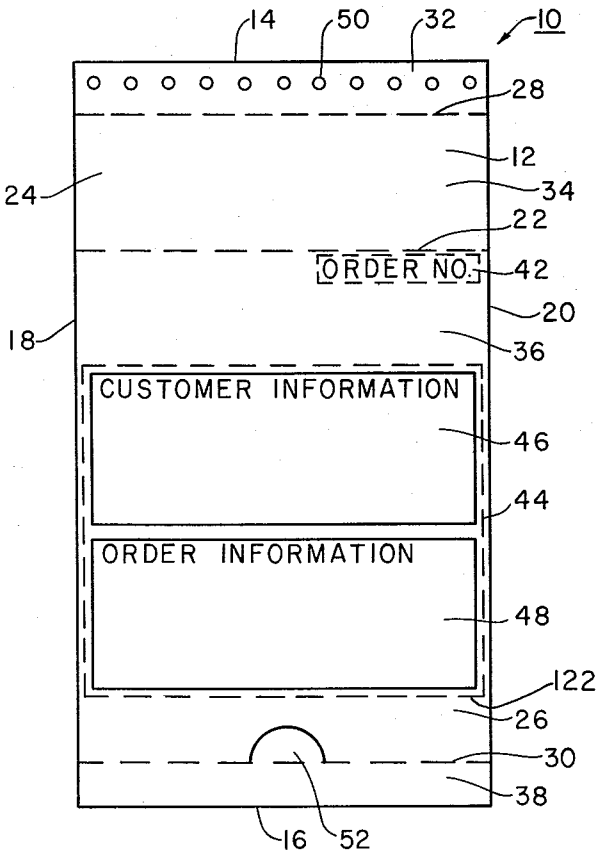
FIG. 1 is a plan view of the front side of the preferred embodiment of the present invention.

Referring to FIG. 1, a preferred embodiment of the present invention is an envelope generally designated 10. The envelope 10 includes a first sheet 12.

The first sheet 12 has a first end or top 14, a second end or bottom 16 opposite the first end 14, a first or left side edge 18 and a second or right side edge 20 opposite the first side edge 18. The ends 14, 16 are substantially straight and parallel, and the side edges 18, 20 are substantially straight, parallel to each other and substantially perpendicular to the ends 14, 16. Thus, the first sheet 12 has a generally rectangular shape, with a preselected length between the ends 14, 16 and a preselected width between the side edges 18, 20.

The first sheet 12 further has a fold line 22 for folding of the sheet 12. The fold line 22 is remote from the ends 14, 16, closer the end 14, and extends from the side edge 18 to the side edge 20, substantially parallel to the ends 14, 16. Thus, the fold line 22 divides the first sheet 12 into two generally rectangular portions 24, 26. The first portion 24 is defined between the end 14 and the fold line 22, and the second portion 26 is defined between the fold line 22 and the second end 16. As will be described, the first portion 24 is a flap portion, and the second portion 26 is an envelope portion.

The first sheet 12 further has a first perforation line 28 and a second perforation line 30. The first perforation line 28 is adjacent the first end 14, closer to the first end 14 than to the fold line 22. The first perforation line 28 is parallel to the end 14 and extends across the first sheet 12 between the side edges 18, 20. The first perforation line 28 divides the first portion 24 of the first sheet into two generally rectangular sections 32, 34. The first or upper section 32 is defined between the first end 14 and the first perforation line 28, while the second or lower section 34 is defined between the first perforation line 28 and the fold line 22. The section 32 is a flap stub section, and the section 34 is a flap section. The flap stub section 34 has tractor holes 50 for use of the envelope 10 in an automatic form feeding machine.

The second perforation line 30 is adjacent the second or lower end 16, closer to the second end 16 than to the fold line 22, substantially parallel to the second end 16 and at a distance substantially equal to the distance between the first perforation line 28 and the first end 14. The lower portion 26 of the first sheet 12 is thus divided into two generally rectangular sections 36, 38. The first or upper section 36 is an envelope section and the second or lower section 38 is an envelope stub section.

The first perforation line 28 has less resistance to perforation than the second perforation line 30, or the other perforation lines of the envelope 10 described below. Thus, tension exerted on the envelope 10 perforates the first perforation line 28 before the second perforation line 30 or the other perforation lines. Tension to perforate the perforation line 28 is exerted across the length of the first sheet 12. The user grasps the first sheet at either end 14, 16 and pulls back on the ends 14, 16. Near the end 16, a thumb marker or pull tab 52 is defined on the envelope section 36 for guiding the exertion of tension.

The first sheet 12 carries on its outer or front side or face 40, which is the face appearing in FIG. 1, an index zone 42 and an information zone 44. The zones 42, 44 are within the envelope section 36. The index zone 42 is for preprinted index data such as order number and vendor name, and is located along the top edge or at a top corner of the envelope section 36. The zone 44 is located centrally within the section 36, for the recordal of customer identification information such as name and address, and order information such as date, film type, print quantity, and special instructions. As illustrated in FIG. 1, the zone 42 includes a pre-printed order number and the zone 44 includes two areas 46, 48. The first area 46 is for the recordal of customer information and the second area 48 is for the recordal of order information.

Figure 3:
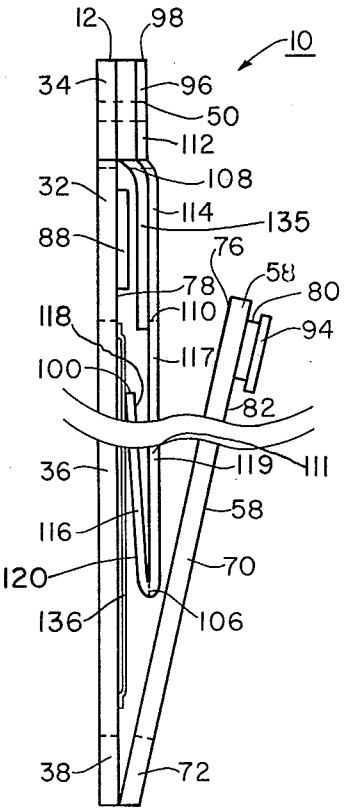
FIG. 3 is a side view of the present invention, enlarged and partially exploded for clarity of detail.
Figure 2:
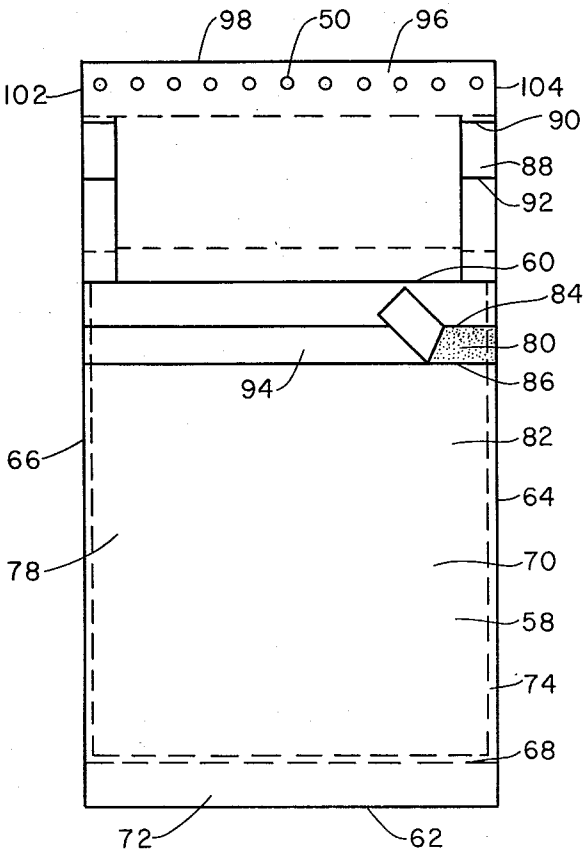
FIG. 2 is a plan view of the back side of the preferred embodiment of the present invention.
Figure 4:
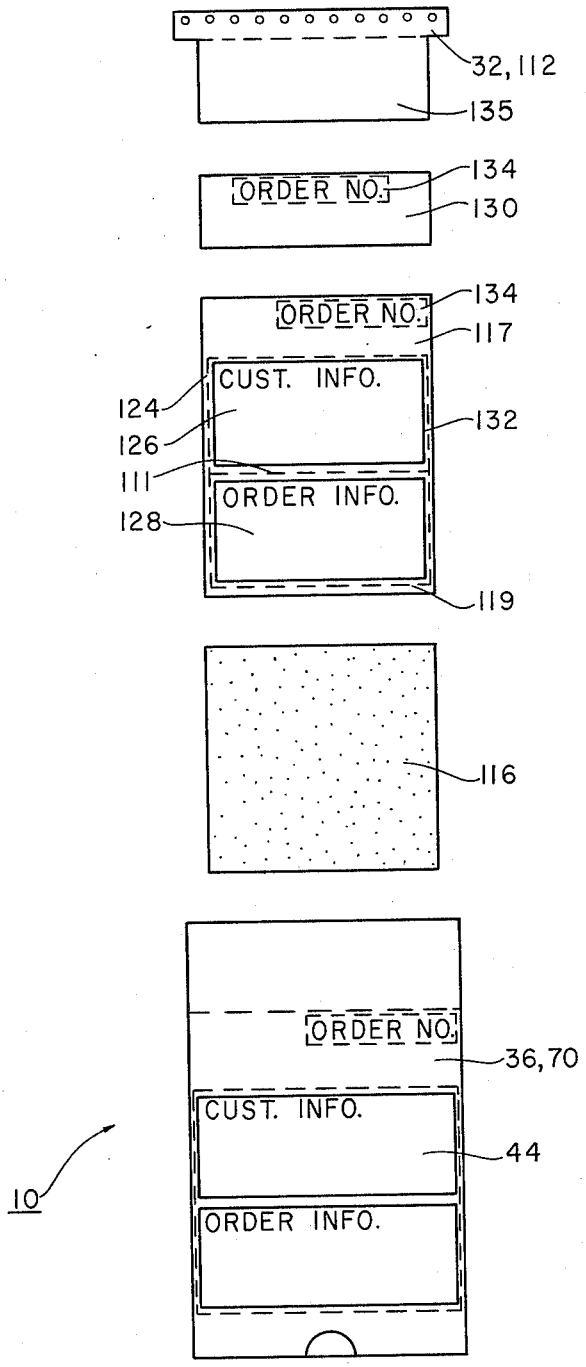
FIG. 4 is an exploded plan view of the preferred embodiment, with the components thereof separated along perforation lines which are a part of the preferred embodiment.

Referring now to FIGS. 2–4, the envelope 10 includes, in addition to the first sheet 12, a second sheet 58. The second sheet 58 has a first or top end 60, a second or bottom end 62 opposite the first end 60, a first side edge 64 and a second side edge 66. The first side edge 64 and the second side edge 66 extend between the ends 60, 62. The second side edge 66 is opposite the first side edge 64. The edges 64, 66 and the ends 60, 62 are substantially straight, with the ends 60, 62 parallel to each other and with the edges 64, 66 parallel to each other and perpendicular to the ends 60, 62. Thus, the second sheet 58 has a generally rectangular shape, like the first sheet 12.

The second sheet 58 has a length between the ends 60, 62 about equal to but less than the distance between the fold line 22 and the second end 16. The second sheet 58 also has a width between the side edges 64, 66 about equal to the width of the first sheet 12 between its side edges 18, 20. Further, the second sheet 58 has a third perforation line 68 extending between the edges 64, 66 parallel to the end 62. The perforation line 68 is at a distance from the end 62 substantially equal to the distance between the second perforation line 30 and the second end 16 of the first sheet 12. The second sheet 58 thus has two sections 70, 72, an envelope section 70 and an envelope flap section 72. The sections 70, 72 match, respectively, the envelope section 36 and the envelope stub section 38 of the first sheet 12.

The second sheet 58 is joined or attached to the first sheet 12. An adhesive is applied to the first sheet in an adhesive zone 74. The zone 74 extends along the side edges 18, 20 between the fold line 22 and the second end 16, and along the second end 16, from the second end 16 to a line adjacent the second perforation line 30 on the side thereof closer the first end 14. The second sheet is adhered to the first sheet across the zone 74, with the ends 16, 62 aligned, the side edges 18, 64 aligned and the side edges 20, 66 aligned. As so joined, the sheets 12, 58 form an envelope space or pocket 75 extending across and along the envelope sections 36, 70.

The pocket 75 is for the retention of the photographic film and the like. The pocket 75 has a single opening 77 across the first end 60 of the second sheet 58. When the flap section 34 is folded over the second sheet 58, along the fold line 22, the opening 77 is covered. The first or front side of face 76 of the second sheet 58 faces the second side or face 78 of the first sheet 12. The pocket 75 is thus formed between the faces 76, 78.

As shown in FIGS. 2 and 3, a contact adhesive strip 80 formed of adhesive material is located on the second or back side or face 82 of the second sheet 58. The strip 80 has a width from the side edge 64 to the side edge 66 of the second sheet 58, and a length from a first or top edge 84 to a second or bottom edge 86 that is less than the length of the flap section 34 from the first perforation line 28 to the fold line 22. The distance from the fold line 22 of the first sheet 12 to the second or bottom edge 86 of the strip 80 is not greater than the length of the flap section 34.

A first protective strip 88 is located on the first sheet 12. More specifically, the first protective strip 88 is located on the second side 78 of the flap section 34 of the first sheet 12. The strip 88 has a width extending from the side edge 18 to the side edge 20 of the first sheet 12, and a length from a top edge 90 to a bottom edge 92 that is greater than the length of the adhesive strip 80. The strip 88 is at a distance from the fold line 22 such that the top edge of the strip 88 is further from the fold line 22 than the bottom edge 86 of the strip 80, and the bottom edge 92 of the strip 88 is nearer the fold line 22 than the top edge 84 of the strip 80. The strip is so sized and positioned so that the strip 88 protects the flap section 34 from the strip 80.

The protective strip 88 is formed of material which releasably adheres to the adhesive of the adhesive strip 80 upon the application of contact pressure, without loss of fibers or the like to permanent attachment to the strip 80. The strips 80, 88 are joined to the flap section 34 and the envelope section 70 so that separation of the strips 80, 88 does not separate either strip 80, 88 from sections 34, 70, respectively. Thus, since the strip 88 is longer than the strip 80 and positioned so that the strip 80 contacts only the strip 88 when the flap section 34 is folded over to contact the envelope section 70, the strip 88 protects the flap section 34 from damage due to adherence to the strip 80. The strips 80, 88 also provide a substantially complete seal across the opening 77 of the pocket 75 formed by the envelope sections 34, 70.

A second protective strip 94 is located over the adhesive strip 80. The strip 94 has the shape and characteristics of the first protective strip 88, but is attached to the envelope 10 only by its adherence to the adhesive strip 80. The strip 94 thus acts to protect the adhesive strip 80 until closure of the envelope is desired. At that time, the strip 94 is removed and discarded. As most preferred, the strip 94 is made of 30 Nicholite Offset Silicone tape, coated #24 top and bottom, the strip 88 is made of Med. Duty No. 221 Vylon tape, and the strip 80 is made of removable transfer tape.

To provide for receipts as described summarily above, the envelope 10 includes a third sheet 96. Referring again to FIGS. 2 and 3, the third sheet 96 includes a first or top end 98, a second or bottom end 100 opposite the first edge 98, a first side edge 102 extending between the ends 98, 100, and a second side edge 104 opposite the first side edge 102. The ends 98, 100 are substantially parallel to each other, and the edges 102, 104 are substantially parallel to each other and perpendicular to the ends 98, 100.

The third sheet 96 also has a fold and perforation line 106 and three perforation lines 108, 110, 111. These four lines 106, 108, 110, 111 all extend from side edge 102 to side edge 104, parallel to the ends 98, 100. The lines 106, 108, 110, 111 thus all define portions or sections of the third sheet 96.

The first perforation line 108 defines a receipt stub section 112 and the upper or first edge of a receipt portion 114. The receipt stub section 112 is defined between the first end 98 and the first perforation line 108. The receipt stub section 112 has a length and a width substantially equal to the length and width, respectively, of the flap stub section 32 of the first sheet 12.

The fold and perforation line 106 defines the bottom or second edge of the receipt portion 114 and further defines a transfer portion 116. The receipt portion 114 thus extends from the first perforation line 108 to the fold and perforation line 106. The transfer portion 116 extends between the fold line 106 and the second end 100 of the third sheet 96.

The third sheet 96 is attached to the first sheet 12 and fits loosely between the first sheet 12 and the second sheet 58 when the sheets 12, 58 are joined. The width of the third sheet 96 from the edge 102 to the edge 104 along the portions 114, 116 is reduced from that of the receipt stub section 112 and is less than the width of the pocket formed by the sheets 12, 58. The third sheet 96 is attached to the first sheet 12 with the first ends 14, 98 aligned. The length of the third sheet 96 from the first end 98 to the fold and perforation line 106 is less than the distance from the first end 14 of the first sheet 12 to the adhesive along the second perforation line 30, and the transfer portion 116 is folded over against the receipt portion 114.

The transfer portion 116 transfers information recorded upon the envelope section 36 of the first sheet 12 to the receipt portion 114 of the third sheet 96, upon recordal. Along the first or front face 118 of the third sheet 96, the transfer portion 116 is coated with a material which is transferable to adjacent, contacting sheets upon the application of pressure to the second or back face 120 of the third sheet 96. The transfer portion 116 has a width and length greater than the width and length, respectively, of the information zone 42. The third sheet 96 has a length from the first end 98 to the fold line 106 greater than the distance between the first end 14 and the bottom edge 122 of the information zone 44. As shown in FIG. 4, the receipt portion 114 of the third sheet 96 has an information zone 124 matching the information zone 44. A customer information area 126 of the zone 124 matches the area 46 and an order information area 128 matches the area 48. Recordal of information on the zone 44 thus simultaneously records information on the zone 124.

Referring again to FIGS. 2 and 3, and also to FIG. 4, the perforation line 110 defines two receipt sections 130, 132 on the receipt portion 114. The first or upper receipt section 130 is defined between the perforation lines 108, 110 and the second or lower receipt section 132 is defined between the perforation line 110 and the fold and perforation line 106.

The third perforation line 111 defines two parts 117, 119 of the lower receipt section 132. The zone 124 extends across the perforation line 111, with the customer information area 126 on the upper part 117 and the order information area 128 on the lower part 119.

Each receipt section 130, 132 has an index zone 134 substantially identical to the index zone 42. The index zone 134 on the receipt section 132 is on the upper part 117 with the customer information area 126. The receipt sections 130, 132 thus serve as separate receipts for identifying the envelope 10 with which they belong, and the part 119 of the section 132 serves as an aid in accounting the order to which the envelope 10 relates.

Referring to FIG. 3 alone, the sheets 135, 136 are for production purposes. The sheets 135, 136 act as carrier sheets while the envelope 10 is formed in continuously operating machines, such as a collater die cut unit.

As thus constructed, the envelope 10 is utilized as follows. A photographer takes his unprocessed photographic film to a vendor of the services of a laboratory, where the photographer or the vendor records information for the laboratory in the information zone 44. Once the information is fully recorded, the photographer or vendor grasps the envelope 10 at the bottom end along the stub sections 16, 72 and at the top end along the stub sections 32, 112, and exerts tension upon the envelope 10, with a snap. As a result, the first sheet 12 separates along the perforation line 28.

Upon the separation of the first sheet 12, the stub section 34 of the first sheet 12 and the whole of the third sheet 96 are free of the remainder of the first sheet 12. As a result, the section 34 and the third sheet 96 can be readily pulled away from the first sheet 12. The film is then placed in the pocket 75 formed by the sheets 12, 58 and the pocket 75 is sealed by peeling away the second protective strip 94, folding the flap section 34 over toward the second sheet 58, and pressing the first protective strip 88 against the exposed adhesive strip 80. The sealed envelope with the fully recorded laboratory information can then be sent to the laboratory. No risk is created that the processed film or any prints made from the film will be damaged by the transfer material, because the transfer portion 114 of the third sheet 96 has been removed from the envelope 10.

The third sheet 96 is then perforated along the perforation lines 106, 108, 110 and the stub sections 32, 112 disposed, along with the transfer portion 116. Separation of the envelope as described is shown in FIG. 4. As can be seen, the separation results in two receipts 130, 132, with one of the receipts having all the information given to the laboratory. The first receipt 130 may be given to the photographer, and the second receipt 132 may be retained by the vendor, or vice versa. Thus, either the photographer or the vendor retains a receipt having all the information given to the laboratory, and the other person also retains a receipt.

Upon receipt of the envelope 10, the laboratory opens the envelope 10, removes the film, reseals the envelope 10 and processes the film. When processing is complete, the envelope 10 is opened, the film and other desired materials are placed in the envelope 10, the envelope 10 is resealed, and the envelope 10 is returned to the vendor.

If the vendor has retained the receipt 132 with the laboratory information, the vendor will have organized an alphabetical file of its receipts, based on photographers' names. The vendor may then rapidly locate the envelope 10 from among his other envelopes, even if the photographer does not present the vendor with his receipt 130. The vendor may do this by simply asking the name of the photographer and locating the receipt in the alphabetical file.

The envelope 10 is then given to the photographer, who may use the envelope 10 as he pleases. If the photographer desires to store film and prints in the envelope 10, he may do so, with assurance he will not lose the film or prints from the envelope 10.

The vendor may then remove the receipt 132 from the alphabetical file. If desired, it can be disposed. If, however, the vendor seeks to account for the services of the laboratory and tabulate periodic totals of types and quantities of orders, the vendor may separate the receipt 132 into its two parts 117, 119, and retain the part 119.

As should now be apparent, the present invention is a new, useful and non-obvious contribution to the art. As should also be apparent, a variety of changes can be made to the preferred embodiment without departing from the substance of the invention. Therefore, to particularly point out and distinctly claim the subject matter regarded as invention, the following claims conclude this specification.

What is claimed is:

1. An envelope for use in the transfer of documents and things such as processed and unprocessed photographic film, the envelope comprising:

a first sheet having (a) a first end, (b) a second end opposite the first end, (c) a first side edge extending between the first end and the second end, (d) a second side edge opposite the first side edge and extending between the first end and the second end, (e) an inner side, (f) an outer side opposite the inner side, (g) a fold line remote from the first end, remote from the second end and extending between the first side edge and the second side edge, the fold line defining two portions of the first sheet, (h) one of the two portions being a flap portion defined between the fold line and the first end, (i) the other of the two portions being an envelope portion defined between the fold line and the second end, (j) a perforation line between the first end of the first sheet and the fold line of the first sheet and extending from the first side edge of the first sheet to the second side edge of the first sheet, the perforation line defining two sections of the flap portion of the first sheet, (k) one of the two sections of the flap portion being a first stub section defined between the first end of the first sheet and the perforation line, (l) the other of the two sections of the flap portion of the first sheet being a flap section defined between the perforation line and the fold line, and (m) a first information zone defined on the outer side of the first sheet within the envelope portion, for the recordal of pre-selected information thereon;

a second sheet having (a) a first end, (b) a second end opposite the first end, (c) a first side edge extending between the first end and the second end, (d) a second side edge opposite the first side edge and extending between the first end and the second end, (e) an inner side, (f) an outer side opposite the inner side, (g) a length between the first end and the second end substantially equal to the distance between the fold line and the second end of the first sheet, and (h) a width between the first side edge and the second side edge substantially equal to the distance between the first side edge and the second side edge of the first sheet;

means for attaching the second sheet to the first sheet so as to form an envelope space with the inner side of the first sheet facing the inner side of the second sheet, the second end of the second sheet generally aligned with and attached to the second end of the first sheet, the first side edge of the second sheet generally aligned with and attached to the portion of the first side edge of the first sheet along the envelope portion thereof, and the second side edge of the second sheet generally aligned with and attached to the portion of the second side edge of the first sheet along the envelope portion thereof;

a contact adhesive strip having a width substantially equal to the distance between the first side edge of the first sheet and the second side edge of the first sheet, and a pre-selected length;

a protective strip for protecting the envelope from damage from the contact adhesive strip having a width and a length substantially equal to the pre-selected width and pre-selected length, respectively, of the adhesive strip;

one of the adhesive strip and the protective strip joined to the inner side of the first sheet adjacent the first end thereof and extending from the first side edge of the first sheet to the second side edge of the first sheet, the other of the adhesive strip and the protective strip joined to the outer side of the second sheet at a distance from the first end thereof substantially equal to the distance of the one strip from the fold line of the first sheet and extending from the first side edge of the second sheet to the second side edge of the second sheet, so that the one strip overlies the other strip when the first sheet is folded along the fold line and the flap portion of the first sheet is brought into contact with the outer side of the second sheet;

the adhesive strip thereby adhering to the protective strip and the envelope being readily reuseable by separation of the contact adhesive strip from the protective strip;

a third sheet having (a) a first end, (b) a second end opposite the first end, (c) a first side edge extending between the first end and the second end, (d) a second side edge opposite the first side edge and extending between the first end and the second end, (e) a first side, (f) an information zone defined on the first side of the third sheet for the recordal of pre-chosen information thereon, the pre-chosen information being chosen from among the pre-selected information, (g) the length between the first edge of the third sheet and the information zone of the third sheet substantially equal to the distance between the first information zone and the first edge of the first sheet, (h) a width along at least a portion of the third sheet less than the distance between the first side edge and the second side edge of the first sheet so that the third sheet fits within the envelope space defined by the first sheet and the second sheet;

means for attaching the third sheet to the first stub portion of the first sheet, the third sheet thereby being attached to the first stub portion with the first edges of the first sheet and the second sheet generally aligned, the first side of the third sheet adjacent the inner side of the first sheet and the third sheet within the envelope space of the first sheet and the second sheet;

transfer means for transferring upon recordal the pre-chosen information from the information zone of the first sheet to the information zone of the third sheet, the transfer means positioned between the information zones of the first sheet and the third sheet; and means for attaching the transfer means to the third sheet;

whereby the pre-selected information may be recorded on the first sheet, the first perforation line perforated and the third sheet removed from the envelope space, the result being, without further recordal of information and without need of a separate receipt, an envelope for the safe transfer of documents and things having the pre-selected information thereon and a separate sheet for retention as a receipt with the pre-chosen information thereon, and whereby the envelope can be used in the transfer of unprocessed photographic film to a processor for processing, reused for the return transfer of the film after processing, and reused for film storage.

2. An envelope as in claim 1 wherein the third sheet further has, (h) a second perforation line extending between the first side edge of the third sheet and the second side edge of the third sheet, the second perforation line defining two portions of the third sheet, (i) one of the two portions of the third sheet being a second stub portion defined between the first edge of the third sheet and the second perforation line of the third sheet, (j) the other of the two portions of the third sheet being a receipt portion defined between the second perforation line of the third sheet and the second edge of the third sheet; and wherein the means for attaching the third sheet to the first sheet attaches the second stub portion to the first stub portion;

whereby the second perforation line may be perforated and the first stub portion and the second stub portion removed from the third sheet for disposal.

3. An envelope as in claim 2 wherein the third sheet includes the transfer means as a transfer portion, the third sheet having, (k) a fold and perforation line extending between the first side edge and the second side edge of the third sheet, located between the first perforation line and the second end of the third sheet, and joining the receipt portion of the third sheet to the transfer portion, whereby the fold and perforation line may be folded and the transfer portion may be folded against the receipt portion of the third sheet for positioning between the information zones, and whereby the fold and perforation line may be perforated and the transfer portion of the third sheet separated for disposal.

4. An envelope as in claim 3 wherein the third sheet further has, (l) a third perforation line extending between the first side edge and the second side edge of the third sheet, the third perforation line located between the first perforation line and the second end of the third sheet and defining two sections of the receipt portion of the third sheet, (m) one of the two sections of the third sheet being a first receipt section, and (n) the other of the two sections of the third sheet being a second receipt section, the information zone of the third sheet being on the second receipt section, whereby the third perforation line of the third sheet may be perforated and the first and second receipt sections of the third sheet may be separated, the result being two receipts, one having the pre-chosen information thereon, for use by a photographer and a vendor.

5. The envelope of claim 1 wherein the protective strip is a first protective strip and further comprising a second protective strip, the second protective strip for protecting the contact adhesive strip from deterioration during periods when the contact adhesive strip is not adhered to the first protective strip, the second protective strip having a width and a length substantially equal to the pre-selected width and pre-selected length, respectively, of the adhesive strip and being releasable adhered thereto.

* * * * *